United States Patent [19]

Harding

[11] Patent Number: 4,872,570

[45] Date of Patent: Oct. 10, 1989

[54] TAMPER INDICATOR

[76] Inventor: Claude J. Harding, 3520 E. Cannon Dr., Phoenix, Ariz. 85028

[21] Appl. No.: 271,647

[22] Filed: Nov. 16, 1988

Related U.S. Application Data

[63] Continuation-in-part of Ser. No. 119,389, Oct. 10, 1987, Pat. No. 4,804,096.

[51] Int. Cl.[4] ..... B65D 55/02

[52] U.S. Cl. ..... 215/230; 116/307

[58] Field of Search ..... 215/230, 365; 116/307

[56] References Cited

U.S. PATENT DOCUMENTS 2,939,597 6/1960 Greene ..... 215/230

*Primary Examiner*—Donald F. Norton

[57] ABSTRACT

A second cylindrical element with a side wall oriented generally parallel to the first plane is telescopically interconnected with a first cylindrical element and includes an upper surface. The second cylindrical element is rotationally displaceable between, first, second and third angular positions within a second plane orthogonal to the first plane and is telescopically displaceable between compressed and expanded positions. A biasing device biases the first and second cylindrical elements into the expanded position. A locking device maintains the first and second cylindrical elements in the first angular position when the first and second cylindrical elements are placed in the expanded position. The locking device enables the biasing device to displace the first and second cylindrical elements into the second angular position when the first and second cylindrical elements are displaced from the expanded position into the compressed position. The locking device also enables the biasing device to displace the first and second cylindrical elements into the third angular position when the first and second cylindrical elements are displaced from the compressed position into the expanded position.

17 Claims, 6 Drawing Sheets

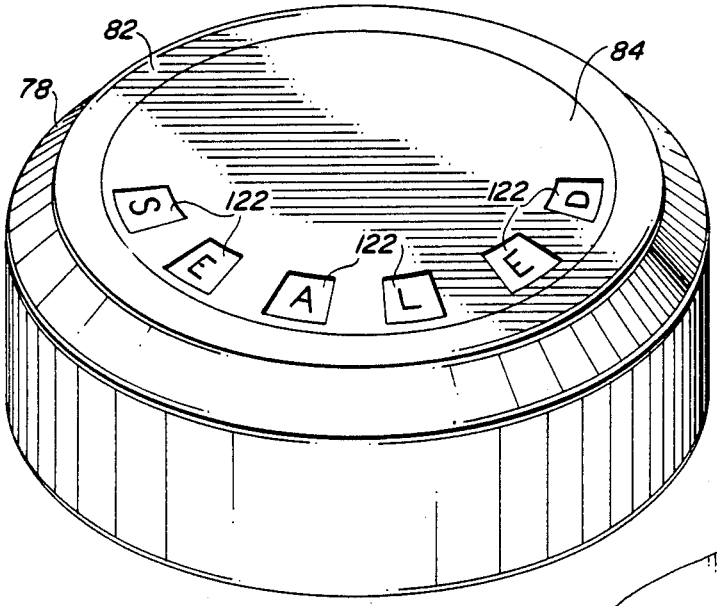
FIG. 21A
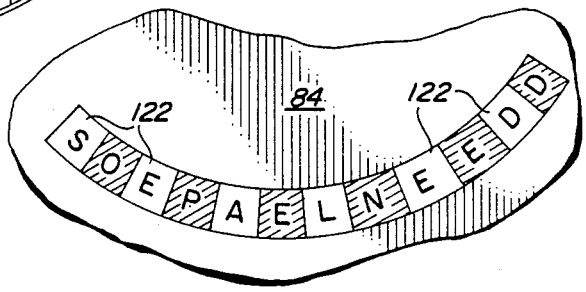
FIG. 21B
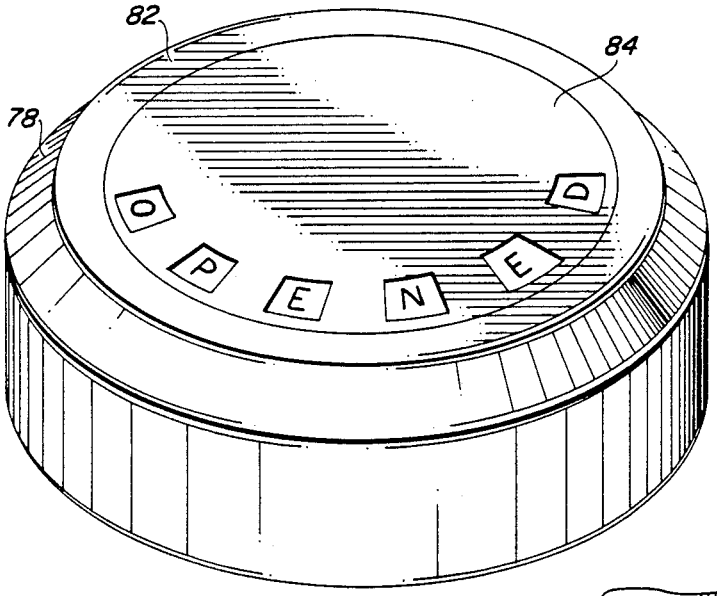
FIG. 22A
FIG. 22B
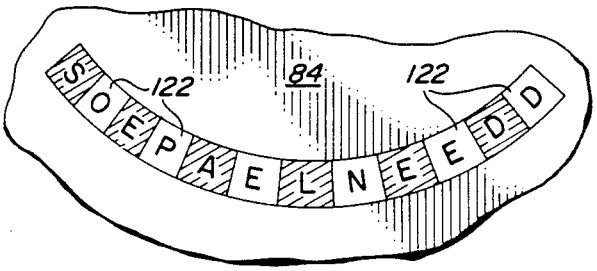
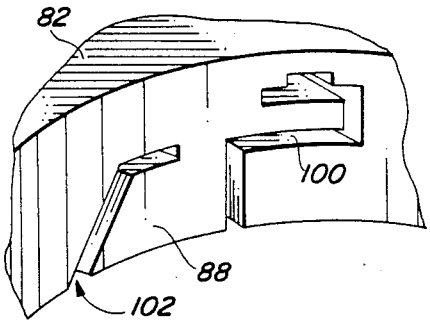
FIG. 23

TAMPER INDICATOR

This is a continuation-in-part patent application of U.S. patent application Ser. No. 119,389, filed Nov. 10, 1987, now U.S. Pat. No. 4,804,096, issued Feb. 14, 1989.

BACKGROUND OF THE INVENTION

1. Field of the Invention

This invention relates to tamper indicators, and more particularly, to tamper indicators which function in response to relative movement between two separate elements of the indicator.

2. Description of the Prior Art

A wide variety of tamper indicators have been developed in the past primarily for application to medication containers including a cap. U.S. Pat. No. 4,424,911 (Resnick) discloses a tamper indicator for medicine bottles which changes color upon the application of pressure to the bottle during opening. A pliable strip is affixed to the exterior of the medication container. The strip contains fragible microspheres which, upon application of pressure caused by opening the container, changes the color of the strip.

U.S. Pat. No. 4,446,979 (Gach et al.) discloses a tamper indicating container having a two section cap. Relative rotation of the two cap sections during container opening displaces an "opened" sign into view on the top of the cap.

U.S. Pat. No. 4,448,317 (Thompson) discloses a tamper indicator for a container which includes a color change mechanism implemented by stress whitening or by an encapsulated coloring agent incorporated into a matrix. The color change is produced as a result of cap rotation.

U.S. Pat. No. 4,475,661 (Griffin) discloses a tamper indicating container having a transparent window in the cap. The indicator assembly includes a defaceable visual pattern such that movement of the cap relative to the receptacle defaces a visual pattern which becomes viewable through the cap.

U.S. Pat. No. 4,500,005 (Forrester) discloses a tamper-evident cap assembly for a container which includes a two-section rotatable bottle cap. Initial opening of the cap rotates one cap section with respect to the second cap section and moves the word "open" into view through an aperture in the top of the cap.

U.S. Pat. No. 4,502,605 (Wloszczyna) discloses a container closure identity system including two cap sections rotatable with respect to each other. One cap section contains dye while the other cap section contains an absorbent sheet together with an actuator. A transparent window in the cap permits the user to observe the color change caused by relative rotation of the two cap sections during opening of the container.

U.S. Pat. No. 4,436,213 (Paul, Jr. et al.) discloses a container having a tamper-evident seal. This device includes a transparent polymer film capable of being rendered transparent by the application of pressure to the film. A safety symbol is visible only if the container has not been previously opened.

U.S. Pat. No. 4,505,399 (Weiner) discloses a tamper-indicating device utilizing a light or oxygen responsive sheet which changes appearance irreversibly upon exposure to either light or oxygen.

U.S. Pat. No. 4,519,515 (Schonberger) discloses a tamper-evident lid for a container including a disc which is seated at the top of a bottle neck. The disc is coated with dye-filled micro capsules. The lower surface of the lid includes an abrasive material which ruptures the micro capsules when the lid is rotated to open the container.

U.S. Pat. No. 4,526,752 (Perlman et al.) discloses an oxygen indicator for packaging where the indicator changes condition upon exposure to oxygen.

U.S. Pat. No. 4,588,098 (Uzdy) discloses an enclosure having tamper indicating means including an indicator marker/pointer which moves in response to opening of the bottle and cannot be returned. This device includes a two-section cap having an upper part which rotates with respect to a lower part upon initial bottle opening.

U.S. Pat. No. 4,591,062 (Sandhaus) discloses a tamper-evident closure apparatus which includes a closure with a mechanism for venting internal pressurized gas upon unsealing of the container. In response to discharge of pressurized gas through a vent, indicator means changes color or is changed in physical shape to indicate tampering.

SUMMARY OF THE INVENTION

It is therefore a primary object of the invention to provide a tamper indicator which is configured into a "locked" state upon completion of manufacture, into an "armed" state upon installation at a site where the tamper indicator is intended to be used, and into an "activated" state when appropriate relative movement is imparted to the device.

Another object of the present invention is to provide a tamper indicator which can be attached to the cap of a medication dispenser without modifying the medication container.

Another object of the present invention is to provide a tamper indicator which produces an irreversible indication of tampering.

Another object of the present invention is to provide a tamper indicator which is inexpensive to fabricate, small in physical size, and entirely incorporated within a single integrated unit.

Briefly stated, and in accord with one embodiment of the invention, a tamper indicator includes a first cylindrical element having an upper wall and a first cylindrical chamber with a side wall oriented generally parallel to the first plane. A second cylindrical element with a side wall oriented generally parallel to the first plane is telescopically interconnected with the first cylindrical element and includes an upper surface. The second cylindrical element is rotationally displaceable between first, second and third angular positions within a second plane orthogonal to the first plane and telescopically displaceable between a compressed position and an expanded position. Indicator means includes a first cylindrical element coupled to the upper wall of the first cylindrical element and a second indicator element. The second indicator element is coupled to the upper surface of the second cylindrical element and is rotationally displaceable with the second cylindrical element. The indicator means displays a first status when the second cylindrical element is positioned in the second angular position and displays a second status when the second cylindrical element is positioned in the third angular position. Biasing means biases the first and second cylindrical elements into the expanded position. Locking means maintains the first and second cylindrical elements in the first angular position when the first and second cylindrical elements are placed in the expanded position. The locking means enables the biasing means to displace the first and second cylindrical elements into the second angular position when the first and second cylindrical elements are displaced from the expanded position into the compressed position. The locking means enables the biasing means to displace the first and second cylindrical elements into the third angular position when the first and second cylindrical elements are displaced from the compressed position into the expanded position. The indicator means display changes from the first status into the second status when the first and second cylindrical elements are displaced from the second angular position into the third angular position.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIGS. 21A and 21B illustrate the manner in which the indicator means displays the first status or the "sealed" or "safe" configuration.

FIGS. 22A and 22B illustrate the third angular position of the first and second cylindrical elements which corresponds to the second status of the indicator means or the "opened" configuration.

FIG. 23 shows an alternative embodiment of the trigger receptacle of the present invention for fitting together the second cylindrical element with the first cylindrical element from below.

DESCRIPTION OF THE PREFERRED EMBODIMENT

Figure 1:
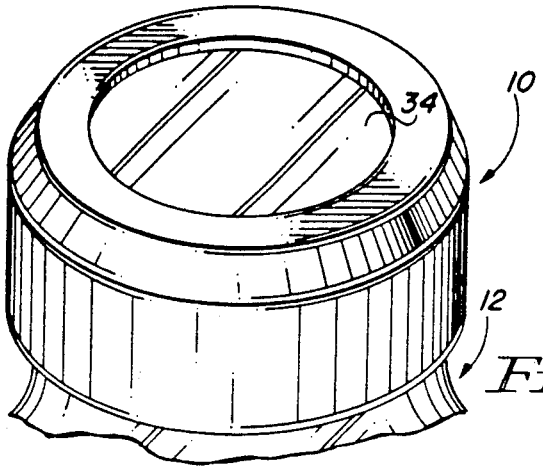
FIG. 1 is a partially cut away perspective view showing the tamper indicator of the present invention embodied in a medication bottle cap and depicting the indicator means prior to change of visual state.

In order to better illustrate the advantages of the invention and its contributions to the art, a preferred hardware embodiment of the invention will now be described in some detail.

Referring now to FIGS. 1, 3, 6 and 7, a preferred embodiment of the tamper indicator of the present invention is shown as being fabricated as a part of a cap 10 of a medication container 12. The tamper indicator includes a first cylindrical element 14 and a second cylindrical element 16 which is telescopically interconnected with first cylindrical element 14 and displaceable between first, second and third positions relative to first cylindrical element 14. First cylindrical element 14 includes a first interior chamber 18 while second cylindrical element 16 includes a second interior chamber 20.

The tamper indicator of the present invention includes indicator means for enabling a consumer to visually determine whether cap 10 has been removed from the mouth of medication container 12 after original assembly and closure of the medication product at the factory. The indicator means includes a first indicator element 22 which is coupled to the first cylindrical element 14 and is positioned within the first interior chamber 18. The indicator means further includes a second indicator element 24 which is positioned within second interior chamber 20 and is displaceable between a first or "safe" position depicted in FIG. 3 where the second indicator element 24 is spaced apart from the first indicator element 22 and a second or "unsafe" position depicted in FIG. 5 where the second indicator element 24 contacts the first indicator element 22 and changes visual state as a result of contact with second indicator element 24.

Figure 6:
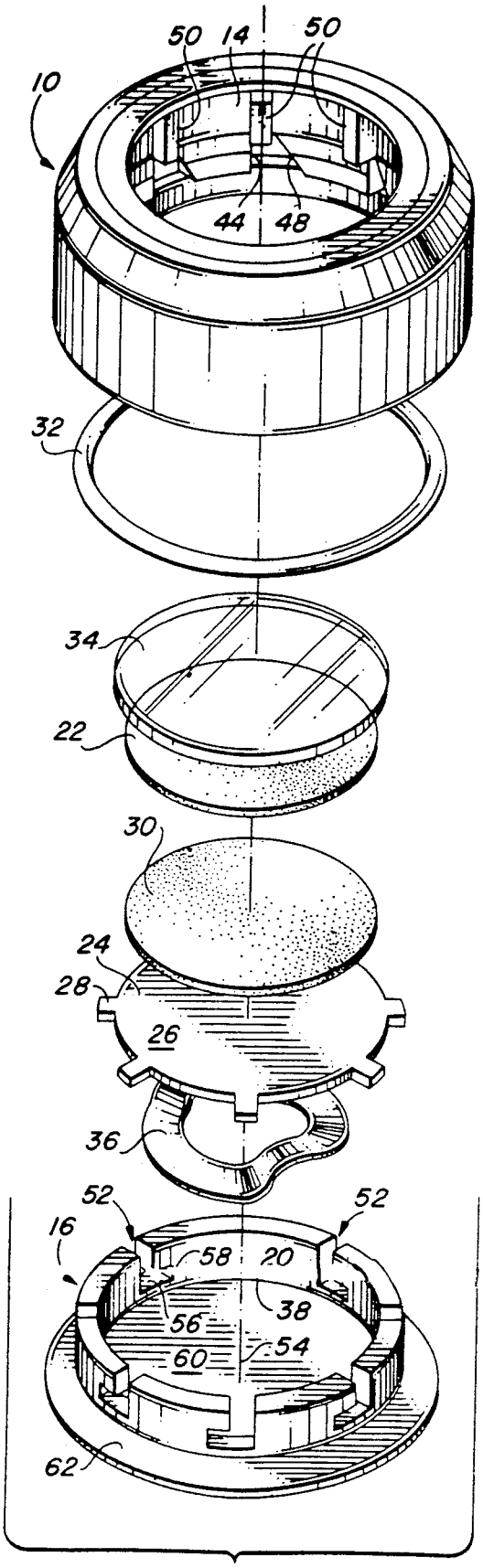
FIG. 6 is a perspective view depicting the various elements of the invention in an exploded configuration.

Second indicator element 24 may be configured as a two part assembly as depicted in FIG. 6 where it includes a thin cylindrical disc 26 including a plurality of circumferentially spaced apart spokes 28 in combination with a separate color change element 30. In the preferred embodiment of the invention depicted in FIG. 6, the color change element 30 takes the form of a reservoir for colored liquid such as red ink. Reservoir 30 may take the form of a sponge, ink reservoir or equivalent device for retaining a colored liquid such as ink and for maintaining such colored liquid in a non-evaporated form for a long period of time. An O-ring seal 32 hermetically seals together the various elements of the tamper indicator to prevent evaporation and loss of the colored liquid from color change element 30.

The first indicator element 22 takes the form of means for receiving colored liquid and may include an absorbent material such as a blotter or equivalent device. The upper surface of the first indicator element 22 is coupled to the lower surface of viewing means which takes the form of a transparent cylindrical window 34 which is fitted into a cylindrical aperture in the upper surface of cap 10. In one embodiment of the invention, color change element 30 includes a predetermined quantity of red ink while the first indicator element 22 takes the form of a white paper blotter.

Biasing means in the form of a piece of spring steel 36 is positioned within the cylindrical chamber defined by the base of second cylindrical element 16, the lower surface of disc 26 and the vertically oriented, cylindrical walls 38 of second cylindrical element 16. Biasing means 36 may take the form of the spring steel element depicted in the drawings or many alternative embodiments including a coil spring as would be readily apparent to one of ordinary skill in the art. Biasing means 36 exerts a constant upward biasing force which biases the first and second indicator elements 22 and 24 together.

Figure 7:
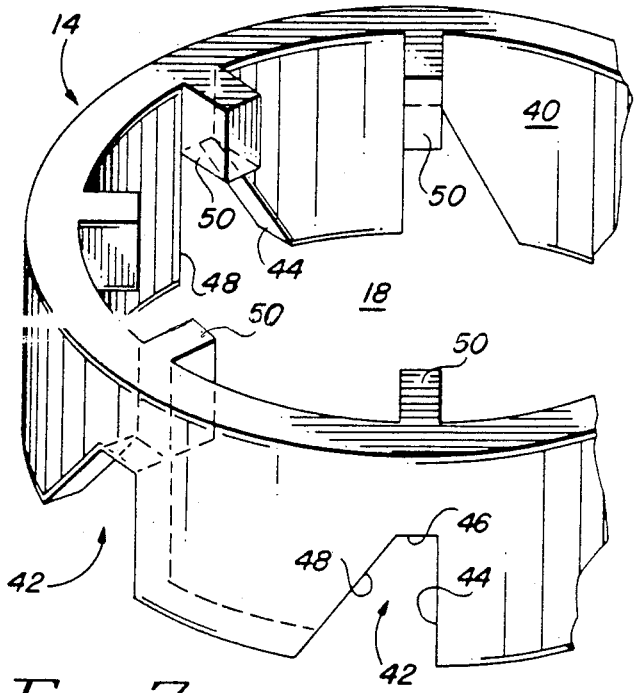
FIG. 7 is a partially cut away perspective view of the first cylindrical element of the invention.

The first cylindrical element 14 includes a vertically oriented wall 40. Wall 40 includes a plurality of circumferentially spaced apart, specially configured cutouts 42 which serve to laterally displace spokes 28 and to thereby rotate disc 26 in a manner explained below. Each cutout 42 includes a vertically oriented surface 44, a horizontally oriented upper surface 46 and an inclined, spoke engaging and displacing surface 48. The wall 40 of first cylindrical element 14 also includes alignment means in the form of a plurality of circumferentially spaced apart, inwardly extending lugs 50 which may be either aligned with the vertical and horizontal surfaces 44 and 46 of cutouts 42 as depicted in FIG. 7 or may be laterally offset from cutouts 42.

Referring now to FIG. 6, second cylindrical element 16 includes a plurality of circumferentially spaced apart, vertically oriented slots 52 which are oriented parallel to the longitudinal axis 54 of the tamper indicator. Slots 52 include a base 56 and a laterally extending notch 58. The second cylindrical element 16 further includes a continuous base 60 which extends outward beyond vertically oriented wall 38 to form a flange 62.

Figure 3:
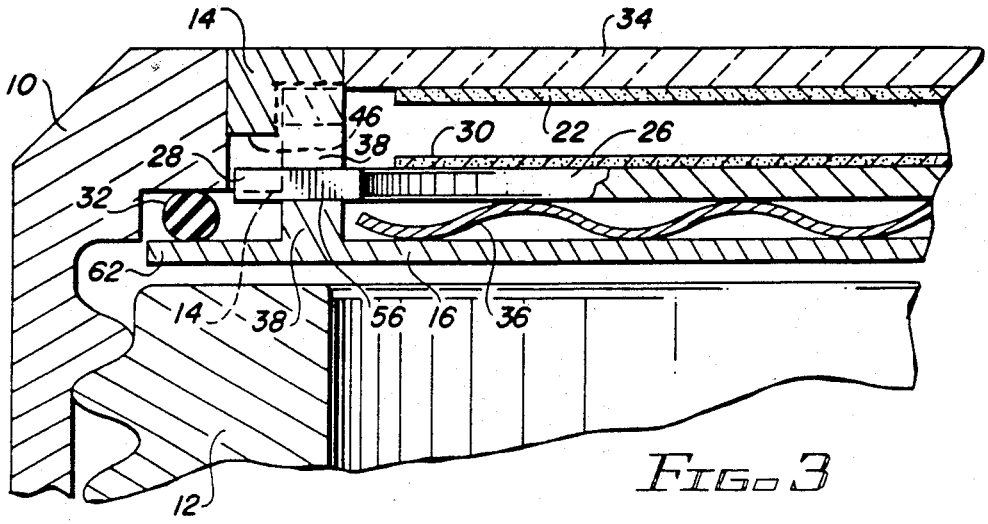
FIG. 3 depicts a partially cut away sectional view of the tamper indicator depicted in FIG. 1 illustrating the "locked" configuration.
Figure 8A:
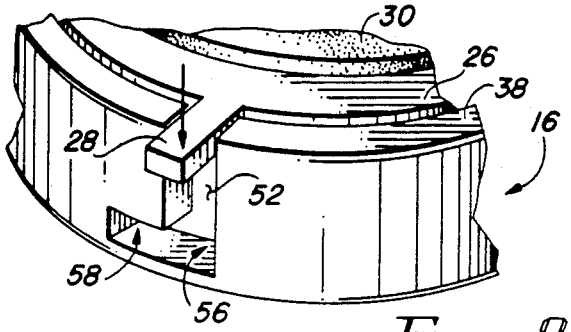
FIGS. 8A–8D show the sequential repositioning of various elements of the present invention between the first, second and third relative positions.

The operation of the invention will now be explained by referring to FIGS. 3, 4, 5 and 8. During the original manufacture of the tamper indicator, the spokes 28 of disc 26 are aligned with the circumferentially spaced apart slots 52 disposed in wall 38 of second cylindrical element 16. As shown in FIG. 8A, disc 28 is vertically displaced with respect to second cylindrical element 16 until each spoke 28 is aligned and level with the laterally extending notches 58 in wall 38. Disc 26 is then rotated in a clockwise direction when viewed from above to displace spokes 28 into the "locked" or first position depicted in FIG. 8B. FIG. 3 also depicts the various elements of the invention in the "locked" or first position before cap 10 is screwed down tightly onto the mouth of medication container 12.

Figure 4:
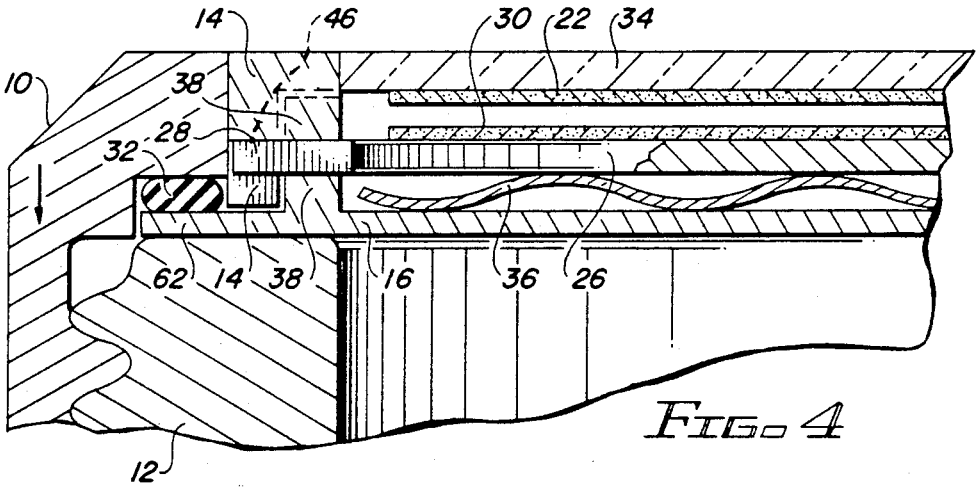
FIG. 4 is a partially cut away sectional view of the tamper indicator of the present invention illustrating the "armed" configuration.
Figure 8B:
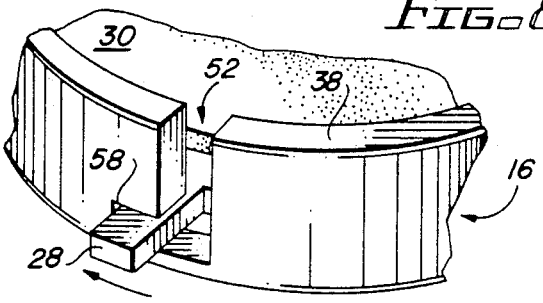
Figure 8C:
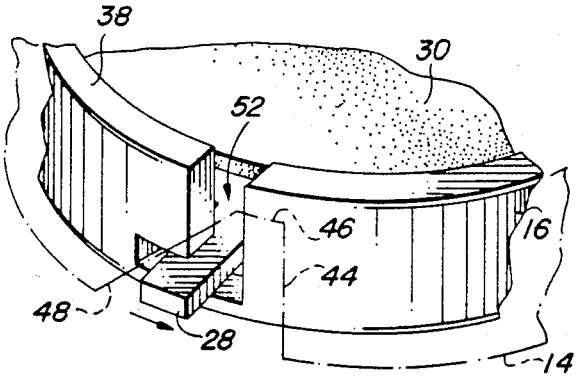

As depicted in FIGS. 4 and 8C, rotation of cap 10 displaces cap 10 downward with respect to the mouth of medication container 12 as illustrated by the compression of O-ring seal 32. The resulting downward displacement of first cylindrical element 14 with respect to the vertically fixed second cylindrical element 16 causes the inclined, spoke engaging surface 48 of first cylindrical element 14 to engage the protruding surface of spokes 28 and to rotate the spokes 28 as well as disc 26 counterclockwise with respect to the remaining, non-rotatable elements of the tamper indicator of the present invention. By the time cap 10 has been downwardly displaced into its fully closed, sealed position depicted in FIG. 4, the horizontally oriented upper surface 46 of cutouts 42 will be displaced into contact with the upper surface of each spoke 28 and each spoke 28 will be vertically aligned within each vertically oriented slot 52 of second cylindrical element 16. This second position of the tamper indicator as depicted in FIGS. 4 and 8B is referred to as the "armed" configuration.

Figure 2:
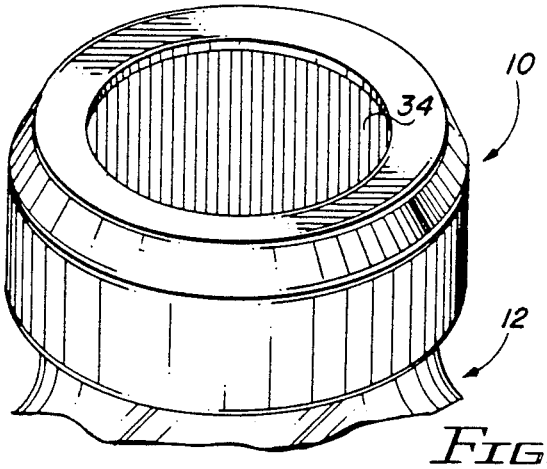
FIG. 2 is a partially cut away perspective view of a medication container cap incorporating the tamper detector of the present invention and depicting the indicator means in the actuated state after a change of visual state.
Figure 5:
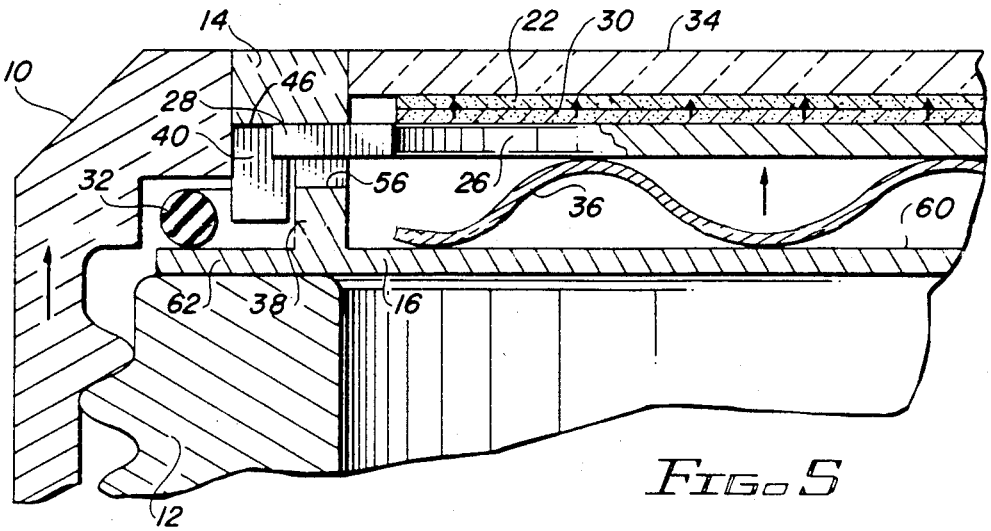
FIG. 5 is a partially cut away sectional view of the present invention showing the tamper indicator in the "actuated" configuration.
Figure 8D:
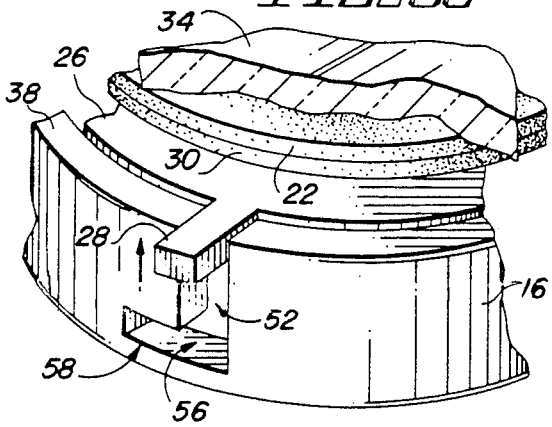
Figure 9:
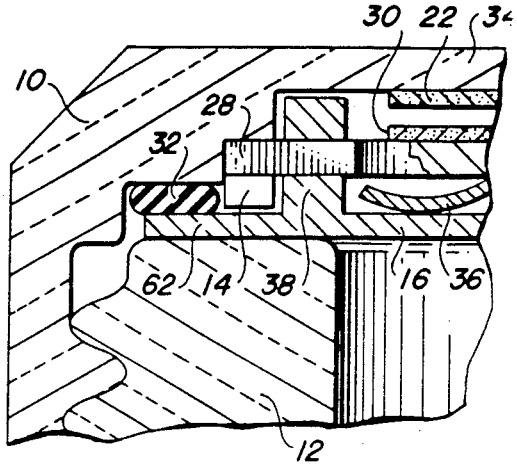
FIG. 9 is a partially cut away sectional view of the present invention showing the tamper indicator formed as an integral part of a medication container cap.

When the cap 10 of medication container 12 is unscrewed by either an unauthorized party or by a consumer, spring 36 causes upward relative displacement between the first cylindrical element 14 as cap 10 is unscrewed while the second cylindrical element 16 remains in contact with the mouth of container 12. This relative longitudinal movement between the first and second cylindrical elements 14 and 16 after slots 28 have been rotated into the "armed" position in alignment with slots 52 causes the second indicator element 30 to be longitudinally displaced and to contact and change the color of first indicator element 22. This color change of first indicator element 22 can be viewed by a consumer through transparent cylindrical insert 34. FIGS. 5 and 8D depict the tamper indicator of the present invention in this third position which is referred to as the "actuated" configuration. FIG. 2 depicts the "unsafe" container configuration after the color change of first indicator element 22 has taken place.

During manufacture, the installation of cap 10 on medication container 12 displaces the elements of the tamper indicator between the first and second positions. As a result of this configuration change, first cylindrical element 14 is longitudinally displaced toward second cylindrical element 16 while disc 26 and spokes 28 are rotationally displaced in a couterclockwise direction as a result of contact and movement between spokes 28 and the inclined, spoke-engaging surface 48 of cutouts 42. During the transition from the second position to the third position, second cylindrical element 16 is longitudinally displaced away from first cylindrical element 14 while spokes 28 are aligned with slots 52, enabling biasing means 16 to displace color change element 30 into contact with first indicator element 22.

The plurality of circumferentially spaced apart lugs 50 disposed around the interior surface of wall 40 of first cylindrical element 14 interface with the upper parts of slots 52 in second cylindrical element 16 and prevent relative rotational displacements between first cylindrical element 14 and second cylindrical element 16 during transitions between the first and second positions as well as between the second and third positions. Lugs 50 and slots 52 therefore serve as alignment means for the tamper indicator.

Figure 10:
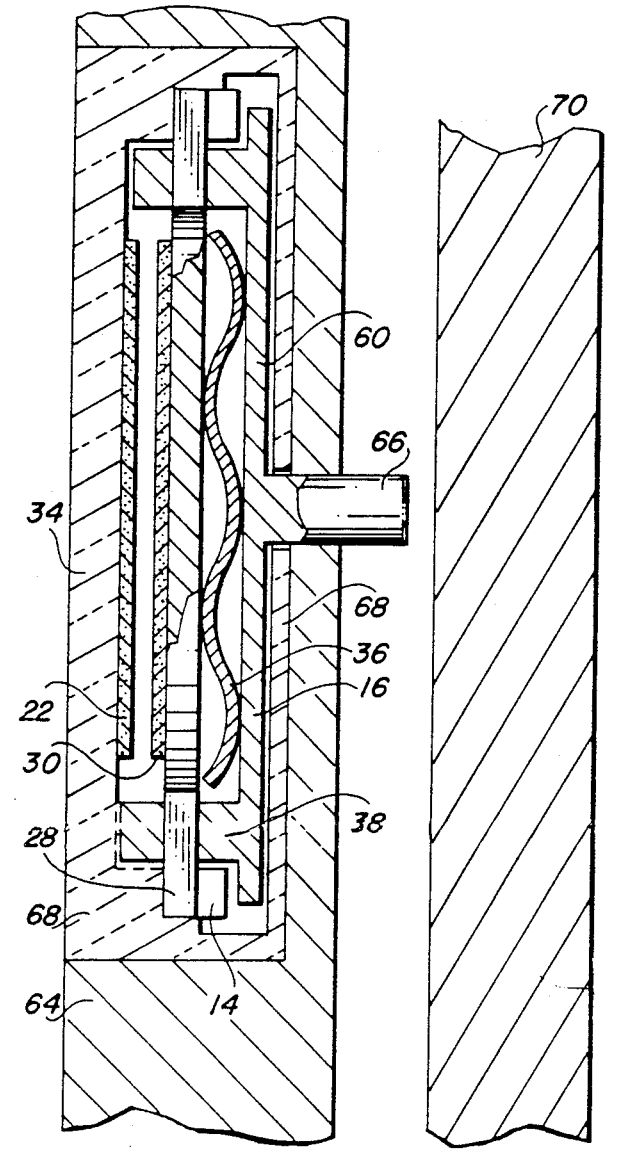
FIG. 10 is a sectional view of another embodiment of the present invention which is used as a tamper indicator for applications other than medication containers.
Figure 11:
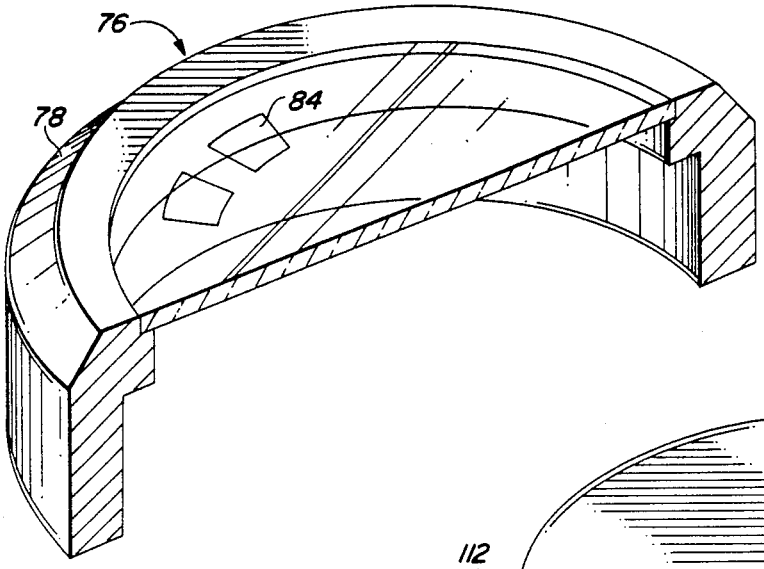
FIG. 11 represents a partially cutaway perspective view of the cap shell which forms a part of the present invention.

FIG. 10 depicts an operationally identical version of the tamper indicator of the present invention installed in the jamb 64 of a door frame. An actuator shaft 66 is coupled to and extends outward from the base 60 of second cylindrical element 16 as illustrated in FIG. 10. A housing 68 is non-displaceably coupled to first cylindrical element 14 and extends around and below the base 60 of second cylindrical element 16 as illustrated. The tamper indicator of FIG. 10 is illustrated in the first or "locked" configuration. Closure of a door 70 against jamb 64 will inwardly displace actuator 66 relative to the remaining elements of the tamper indicator, causing the tamper indicator to be displaced from the first or "locked" position into the second or "armed" position. When door 70 is opened with respect to door jamb 64, actuator 66 is outwardly displaced causing the tamper indicator to be displaced from the second or "armed" position into the third or "actuated" position resulting in a color change of the first indicator element 22 as viewed through transparent cylindrical insert 34.

Except for the differences noted above, the structure and operation of the FIG. 10 embodiment of the invention is identical to the structure of the tamper indicator described in connection with the remaining figures as illustrated in connection with the cap of a medication container.

Referring now to FIGS. 11–14, a second embodiment of the tamper indicator will now be described in detail. In this embodiment of the invention, the tamper indicator designated generally by reference number 76 is configured as a part of a cap 78 which is threadably coupled to the mouth 80 of a bottle.

Tamper indicator 76 includes a first cylindrical element 82 which includes an upper wall 84 and a first cylindrical chamber 86 which is defined by side walls 88 of first cylindrical element 82. Side wall 88 is oriented generally parallel to a first vertical or longitudinal plane which is defined by the center of the circular aperture of the mouth 80 of the bottle.

A second cylindrical element 90 includes a side wall 92 which is oriented generally parallel to the first plane. Second cylindrical element 90 is telescopically interconnected with first cylindrical element 82 and includes an upper surface 94. Second cylindrical element 90 is rotationally displaceable between first, second and third angular positions within a second plane orthogonal to the first plane as will be explained below. Second cylindrical element 90 is displaceable between a compressed position and an expanded position. The expanded position is indicated generally in FIG. 12.

Figure 13:
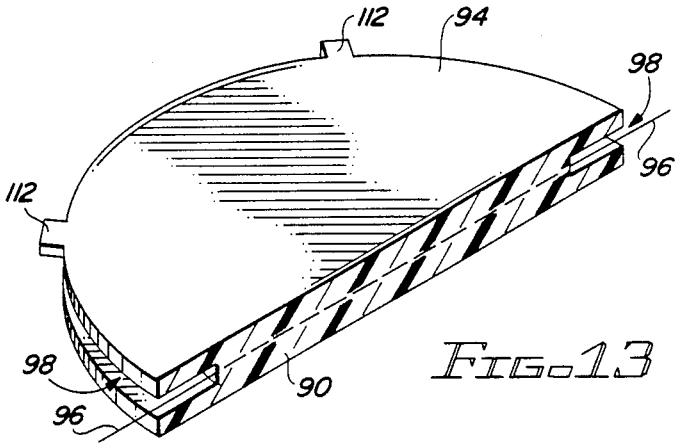
FIG. 13 illustrates a partially cutaway sectional view of the second cylindrical element of the invention.

Biasing means in the form of a spring element 96 extends through and is secured to the body of second cylindrical element 90. Each end of spring element 96 which can be fabricated from piano wire passes through a groove 98 formed in the outer side wall of second cylindrical element 90. The length of spring element 96 is configured to extend beyond the side wall of second cylindrical element 90 as is best illustrated in FIG. 13.

Figure 16A:
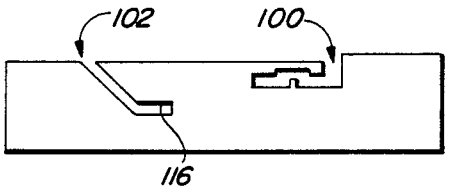
FIG. 16A represents a partially cutaway elevational view of the side wall of the first cylindrical element particularly illustrating the spring receptacle and the trigger receptacle.
Figure 16B:
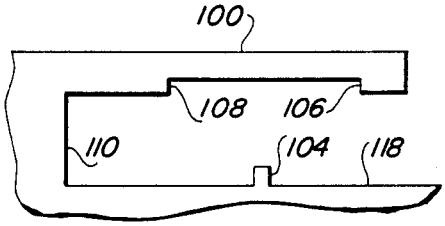
FIG. 16B represents an enlarged, simplified view of the trigger receptacle depicted in FIG. 16A.

Referring now to FIGS. 16A and 16B, side wall 88 of first cylindrical element 82 includes a trigger receptacle 100 and a spring receptacle 102. FIG. 16 shows an enlarged somewhat simplified view of the trigger receptacle depicted in FIG. 16A. As best illustrated in FIG. 16B, the lower linear surface of trigger receptacle 100 includes a vertically extending first trigger stop 104. The upper surface of trigger receptacle 100 includes a first upwardly extending detent 106 and a second downwardly extending detent 108. A vertically oriented end wall 110 of trigger receptacle 100 defines a second trigger stop 110.

Figure 14:
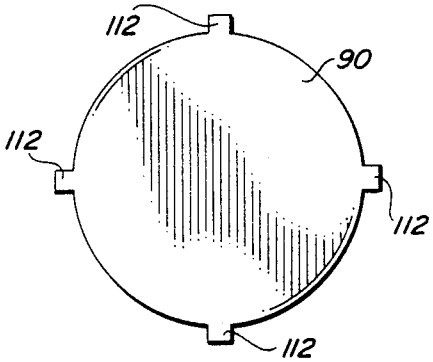
FIG. 14 represents an elevational view of the second cylindrical element particularly illustrating the configuration and location of the trigger elements.
Figure 15:
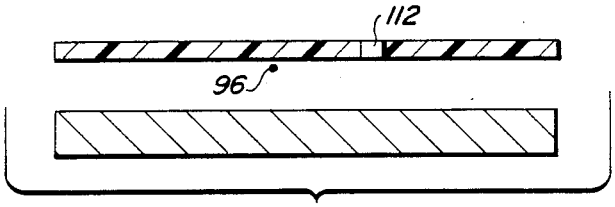
FIG. 15 represents a symbolic sectional view of the second cylindrical element showing the relative location of a trigger element with respect to a spring element.

FIG. 16 illustrates the relative angular or circumferential positions for spring element 96 which respect to trigger element 112 which extends radially outward from the circumference of second cylindrical element 90. FIG. 14 also shows the relative positioning of trigger element 12 with respect to second cylindrical element 90.

Figure 17A:
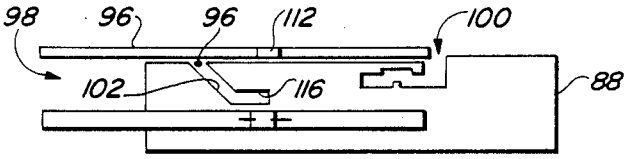
FIGS. 17A, 17B and 17C show the manner in which the second cylindrical element is assembled to interconnect with the first cylindrical element.
Figure 17B:
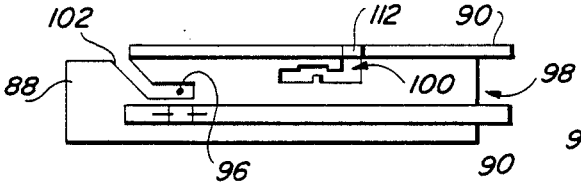
Figure 17C:
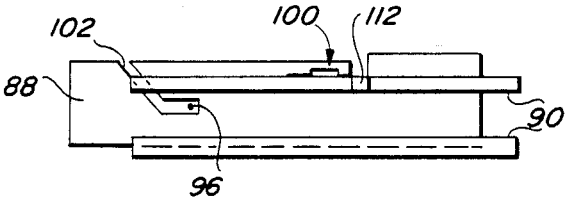

Referring now to FIGS. 17A–17C, the method of telescopically interconnecting second cylindrical element 90 with first cylindrical element 82 of tamper indicator 76 will be described.

In FIG. 17A, second cylindrical element 90 is vertically positioned relative to trigger receptacle 100 such that trigger element 112 lies above the upper surface 114 of side wall 88 of first cylindrical element 82. The tip of spring element 96 is aligned with the entrance of spring receptacle 102. Second cylindrical element 90 is now rotated in a clockwise direction when viewed from above to reposition trigger element 112 from the location illustrated in FIG. 17A into the location illustrated in FIG. 17B. As depicted in FIG. 17B, trigger element 112 is oriented immediately above an aperture in trigger receptacle 100. The clockwise rotation of second cylindrical element 90 with respect to side wall 88 causes spring element 96 to travel downward along spring receptacle 102 until it is seated in the laterally displaced detent section 116 of spring receptacle 102.

Figure 18A:
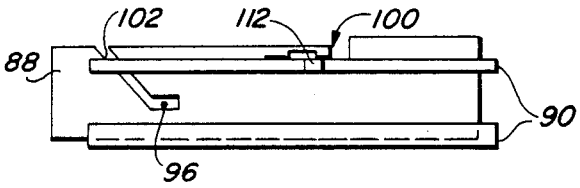
FIG. 18A llustrates the first and second cylindrical elements configured into the first angular position or the "safe" position.
Figure 18B:
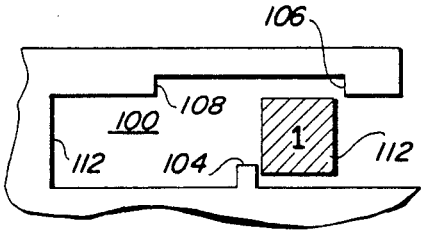
FIG. 18B represents a partially cutaway enlarged view of the locking mechanism illustrated in FIG. 18A.

As illustrated by the transition between FIGS. 17B and 17C, second cylindrical element 90 is vertically displaced downward to seat trigger element 112 along the lower surface 118 of trigger receptacle 100. Spring 96 remains firmly seated in detent section 116 of spring receptacle 102 as illustrated in FIG. 17C. Because of the relative clockwise rotation between second cylindrical element 90 and side wall 88 which took place in the FIG. 17A to FIG. 17B transition, spring 96 as illustrated in FIG. 17C imparts a strong couterclockwise biasing force to second cylindrical element 90. Once trigger element 112 has been seated on the lower surface 118 of trigger receptacle 100 and the external force is removed from second cylindrical element 90, that element rotates a short distance in the counterclockwise direction as illustrated in FIGS. 18A and 18B and seats against and is stopped by first trigger stop 104.

As illustrated in FIG. 18, the tamper indicator of the present invention is in what can be referred to as the "safe" configuration representing completion of assembly and manufacture. In the "safe" configuration, spring 96 exerts a significant couterclockwise biasing force on trigger element 112 which is maintained in a fixed position by first trigger stop 104. In this configuration, first cylindrical element 82 and second cylindrical element 90 are in what is referred to as the "expanded" position where the relative spacing between the lower surface of upper wall 84 and the upper surface 94 of second cylindrical element 90 is maximized as illustrated in FIG. 12.

Figure 12:
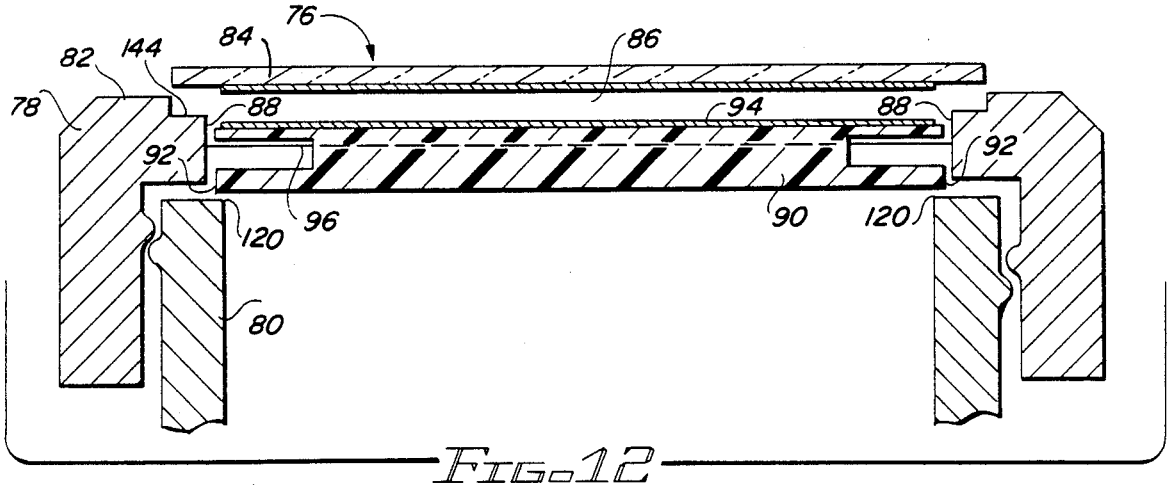
FIG. 12 represents a sectional view depicting the cap and bottle mouth elements of the invention and illustrating the manner in which such elements are interconnected.
Figure 19:
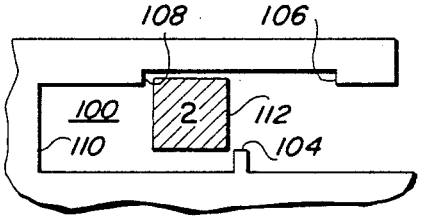
FIG. 19 illustrates the trigger element and trigger receptacle in the second angular position or the "armed" position.

Referring now to FIGS. 12 and 19, when cap 78 is tightened onto the mouth 80 of the bottle, the upper extremity 120 of mouth 80 contacts the lower surface of second cylindrical element 90 and upwardly displaces second cylindrical element 90 with respect to first cylindrical element 82. This upward displacement repositions the first and second cylindrical elements from the expanded position depicted in FIG. 18 into the compressed position depicted in FIG. 19. This upward vertical movement elevates trigger element 112 above the upper extremity of first trigger stop 104 and permits the counterclockwise biasing force generated by spring element 96 to rotate second cylindrical element 90 in a counterclockwise direction until the upper corner edge of trigger element 112 is stopped by second detent 108 as depicted in FIG. 19. This configuration is referred to as the "armed" configurations.

Figure 20A:
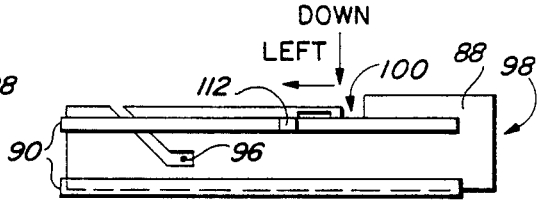
FIGS. 20A and 20B illustrate the trigger element and trigger receptacle in the third angular position or the "activated" position.
Figure 20B:
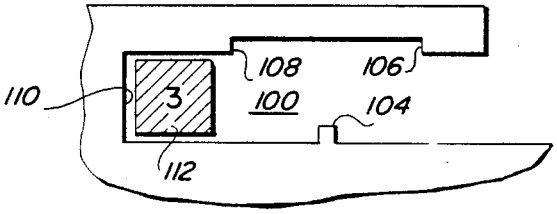

When cap 78 is unscrewed from the bottle mouth 80, the downward biasing force exerted by spring 96 on second cylindrical element 90 will displace that element from the compressed position depicted in FIG. 19 into the expanded position illustrated in FIGS. 20A and 20B. This downward vertical displacement unseats the upper left hand corner of trigger element 112 from second detent 108 allowing the biasing force exerted on second cylindrical element 90 by spring element 96 to further displace both the trigger element 112 and the second cylindrical element 90 further in a counterclockwise direction until trigger element 112 is seated against second trigger stop 110 as depicted most clearly in FIG. 20A. This configuration of tamper indicator 76 is referred to as the "activated" state.

The locking means of the present invention was described above and includes trigger element 112, trigger receptacle 100 including first detent 106, second detent 108, second trigger stop 110 and first trigger stop 104. FIG. 18B depicts the locking means maintaining the first and second cylindrical elements in the first angular position; FIG. 19 depicts those elements in the second angular position; and FIG. 20 depicts those elements in the third angular position.

The indicator means of the invention will now be described in detail by reference to FIGS. 21 and 22. A first indicator element consisting of a plurality of rectangular window elements 112 is depicted in FIGS. 21A and 22A. These transparent window elements are formed in the upper wall 84 of first cylindrical element 82 or cap 78.

A second indicator element of the present invention is formed on the upper surface 94 of second cylindrical element 90 by using any type of alpha/numeric text such as that shown in FIGS. 21B and 22B. This textual material is positioned on upper surface 94 such that when the first and second cylindrical elements are aligned in the second angular position which corresponds to the "armed" configuration depicted in FIG. 19, the indicator means of the present invention assumes the first status depicted in FIG. 21A and 21B. The first status may for example indicate the term "sealed" to a user to indicate that the tamper indicator is in the "armed" configuration in which a medication bottle would be placed after having been sealed at the factory.

Unscrewing cap 78 from bottle mouth 80, causes the tamper indicator to assume the "activated" configuration depicted in FIG. 20 and results in the first and second cylindrical elements being angularly displaced from the second angular position into the third angular position. This relative angular displacement between the first and second cylindrical elements rotates upper surface 94 of second cylindrical element 90 into the configuration depicted in FIG. 22.

In the "activated" configuration of the tamper indicator as depicted in FIGS. 20 and 22, the indicator means of the present invention transitions from the first status depicted in FIG. 21 into the second status as depicted in FIG. 22. In the second status, a textual indication or visual indication appears to the user indicating the "opened" or generally unsafe configuration of the tamper indicator and the attached medication container.

The unique configuration of the indicator means of the present invention permits a very small angular displacement between the first and second cylindrical elements of the present invention to completely alter the text displayed between the first status and the second status of the indicator means. This is achieved by the unique text strip illustrated in FIGS. 21B and 22B which utilizes adjacent alphabetical or numerical characters where alternate letters or characters are displayed in the first indicator means status and in the second indicator means status.

In FIG. 23, an alternative embodiment of the spring receptacle 102 and trigger receptacle 100 in the side wall 88 of first cylindrical element 82 is depicted. In this alternative embodiment, second cylindrical element 90 can be assembled with the remaining elements of the tamper indicator of the present invention by upward displacement from below. In this alternative embodiment of the invention, it will not be necessary to have a removable upper wall 84 as depicted in FIG. 12.

It will be apparent to those skilled in the art that the disclosed tamper indicator may be modified in numerous ways and may assume many embodiments other than the preferred forms specifically set out and described above. Accordingly, it is intended by the appended claims to cover all such modifications of the invention which fall within the true spirit and scope of the invention.

I claim:

1. A tamper indicator comprising:

a. a first cylindrical element having an upper wall and a first cylindrical chamber with a side wall oriented generally parallel to a first plane;

b. a second cylindrical element with a side wall oriented generally parallel to the first plane and telescopically interconnected with the first cylindrical element and including an upper surface, the second cylindrical element being rotationally displaceable between first, second and third angular positions within a second plane orthogonal to the first plane and telescopically displaceable between a compressed position and an expanded position;

c. indicator means including i. a first indicator element coupled to the upper wall of the first cylindrical element;

ii. a second indicator element coupled to the upper surface of the second cylindrical element and being rotationally displaceable with the second cylindrical element, the indicator means displaying a first status when the second cylindrical element is positioned in the second angular position and displaying a second status when the second cylindrical element is positioned in the third angular position;

d. means for biasing the first and second cylindrical elements into the expanded position and for rotationally biasing the first and second cylindrical elements toward the third angular position; and e. locking means for maintaining the first and second cylindrical elements in the first angular position when the first and second cylindrical elements are placed in the expanded position, for enabling the biasing means to displace the first and second cylindrical elements into the second angular position when the first and second cylindrical elements are displaced from the expanded position into the compressed position, and for enabling the biasing means to displace the first and second cylindrical elements into the third angular position when the first and second cylindrical elements are displaced from the compressed position into the expanded position, whereby the indicator means display changes from the first status into the second status when the first and second cylindrical elements are displaced from the second angular position into the third angular position.

2. The tamper indicator of claim 1 wherein the side wall of the first cylindrical element includes a plurality of circumferentially spaced apart trigger receptacles and wherein the locking means includes a plurality of circumferentially spaced apart trigger elements extending outward from the side wall of the second cylindrical element, the trigger elements being configured to fit into the trigger receptacles.

3. The tamper indicator of claim 2 wherein the first cylindrical element includes four trigger receptacles.

4. The tamper indicator of claim 3 wherein the second cylindrical element includes four trigger elements.

5. The tamper indicator of claim 3 wherein the side wall of the first cylindrical element includes four spring receptacles.

6. The tamper indicator of claim 5 wherein the second cylindrical element includes four spring elements.

7. The tamper indicator of claim 2 wherein the biasing means includes:

a. a spring receptacle disposed in the side wall of the first cylindrical element; and b. a spring element extending outward from the side wall of the second cylindrical element into the spring receptacle.

8. The tamper indicator of claim 2 wherein the upper wall of the first cylindrical element includes a window and wherein the window forms the first indicator element.

9. The tamper indicator of claim 8 wherein the second indicator element includes a first indicator device alignable with the window to display the first status and a second indicator device alignable with the window to display the second status.

10. The tamper indicator of claim 9 wherein the window includes a plurality of spaced apart window segments.

11. The tamper indicator of claim 10 wherein the first and second indicator devices include a plurality of alpha/numeric characters.

12. The tamper indicator of claim 11 wherein the first indicator device displays the term "sealed" when the indicator means displays the first status.

13. The tamper indicator of claim 12 wherein the second indicator device displays the term "opened" when the indicator means displays the second status.

14. The tamper indicator of claims 1 or 13 wherein the first cylindrical element forms a cap for a bottle having a mouth.

15. The tamper indicator of claim 14 wherein screwing the cap onto the mouth of the bottle moves the first and second cylindrical elements from the expanded position into the compressed position.

16. The tamper indicator of claim 15 wherein unscrewing the cap from the bottle moves the first and second cylindrical elements from the compressed position into the expanded position and changes the display of the indicator means from the first status to the second status.

17. The tamper indicator of claim 16 wherein the first status displays the terms "sealed" and wherein the second status displays the term "opened."

* * * * *

UNITED STATES PATENT AND TRADEMARK OFFICE

CERTIFICATE OF CORRECTION

PATENT NO. : 4,872,570
DATED : October 10, 1989
INVENTOR(S) : Claude J. Harding

It is certified that error appears in the above-identified patent and that said Letters Patent is hereby corrected as shown below:

Title page, block 63, line 2, "Pat. No. 4,804,096" should read --Pat. No. 4,793,500--.

Col. 1, line 6, "Pat No. 4,804,096, issued Feb. 14, 1989." should read --Pat No. 4,793,500, issued Dec. 27, 1988.--.

Signed and Sealed this

Fifth Day of November, 1991

*Attest:*

HARRY F. MANBECK, JR.

*Attesting Officer*

*Commissioner of Patents and Trademarks*